US008083116B2

(12) United States Patent
Liang

(10) Patent No.: US 8,083,116 B2
(45) Date of Patent: Dec. 27, 2011

(54) BRAKING AND DRIVING MECHANISM FOR NAIL GUN

(75) Inventor: Chia-Sheng Liang, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 304 days.

(21) Appl. No.: 12/579,399

(22) Filed: Oct. 14, 2009

(65) Prior Publication Data

US 2011/0084111 A1 Apr. 14, 2011

(51) Int. Cl.
*B25C 1/04* (2006.01)

(52) U.S. Cl. ..... 227/8; 227/109; 227/120; 227/136

(58) Field of Classification Search ..... 227/119, 227/120, 136, 138, 8, 109
See application file for complete search history.

(56) References Cited

U.S. PATENT DOCUMENTS

| | | | | |
|---|---|---|---|---|
| 5,593,079 | A * | 1/1997 | Mukoyama et al. | 227/8 |
| 5,873,509 | A * | 2/1999 | Liao | 227/109 |
| 6,092,711 | A * | 7/2000 | Tinarelli | 227/109 |
| 6,161,746 | A | 12/2000 | Wey | |
| 6,398,097 | B1 * | 6/2002 | Liang | 227/109 |
| 6,564,985 | B1 | 5/2003 | Chou | |
| 6,641,020 | B1 * | 11/2003 | Yao | 227/109 |
| 6,644,530 | B2 * | 11/2003 | Chen | 227/109 |
| 6,729,524 | B1 * | 5/2004 | Yao | 227/120 |
| 6,908,021 | B1 * | 6/2005 | Wang | 227/8 |
| 6,953,137 | B2 * | 10/2005 | Nakano et al. | 227/8 |
| 7,273,160 | B2 * | 9/2007 | Wey | 227/125 |
| 7,303,103 | B2 * | 12/2007 | Wang | 227/8 |
| 7,600,661 | B2 * | 10/2009 | Adachi | 227/120 |
| 7,980,439 | B2 * | 7/2011 | Akiba et al. | 227/8 |
| 2008/0061104 | A1 | 3/2008 | Lee | |

FOREIGN PATENT DOCUMENTS

| | | |
|---|---|---|
| TW | 321044 | 11/1997 |
| TW | 424653 | 3/2001 |
| TW | M256812 | 2/2005 |
| TW | M269156 | 7/2005 |
| TW | M345683 | 12/2008 |

* cited by examiner

*Primary Examiner* — Scott A. Smith
(74) *Attorney, Agent, or Firm* — Chun-Ming Shih

(57) ABSTRACT

A braking and driving mechanism includes a guide plate, a driving rod, a magazine, and a pressing rod. The pressing rod consists of a bar shaped arm with its two opposite ends extending to respectively form a tongue portion and a pushing portion. A pivot portion is formed between the tongue portion and the pushing portion. The pressing rod is pivotably disposed in the magazine via the pivot portion. An elastic member for driving the arm to transversely press a main body of each of the nails is disposed on the pushing portion. If the number of remaining nails in the magazine is equal to a default number the elastic member drives the tongue portion to move to a position where the tongue portion can block the stopping portion such that the movement of the driving rod is braked.

8 Claims, 11 Drawing Sheets

BRAKING AND DRIVING MECHANISM FOR NAIL GUN

BACKGROUND

The present invention relates to a braking and driving mechanism for a nail gun, and particularly to a pressing rod pivotably disposed in a magazine of a nail gun. The pressing rod can automatically detect the number of remaining nails in the magazine and brakes or releases a driving rod accordingly.

Generally, a braking mechanism is used in a nail gun to automatically detect whether there are adequate nails in a magazine and brake the shooting action of nail guns if there is no nail in the magazine. Usually, the braking mechanism disables a trigger valve of the nail gun thereby reminding of the user to reload nails. Currently, fine nails, for example, a kind of nail commonly called pin nail which has a thickness of about 0.6 millimeters to about 1.2 millimeters, is popularly used in nail guns.

For example, Taiwan issued patent No. 321044 discloses such a braking mechanism for a nail gun, in which a sliding member is employed to push nails into a nail driving groove. A braking member extends from an end side of the sliding member, and is capable of moving in a direction of the nail driving groove together with the sliding member at a displacement of the thickness of a nail after a nail is shot out of the nail gun. Finally, the braking member reaches to a move path of a driving rod of the nail gun to block the driving rod to move. As such, the shooting action of the nail gun is braked, and the user is reminded to reload nails. However, the braking member can merely move at a distance equals to the thickness of the last nail (e.g. about 0.6 millimeters) after the last nail is shot out of the nail gun. In other words, the braking member blocks the driving rod using an area having a width that is equal to the thickness of the last nail (e.g. about 0.6 millimeters). In such conditions, if the operator forcedly presses the driving rod, the driving rod may slide off the braking member. As a result, the braking mechanism fails to brakes the shooting action.

In addition, a technologically advanced braking mechanism is also disclosed in Taiwan issued patent No. M269156. The braking mechanism includes a touch member disposed on a nail driving member of a nail gun. An open end groove is defined in an end side of a magazine of the nail gun. A braking member that is capable of being triggered by the touch member to swing is pivotably disposed in the end groove. The touch member moves towards a direction of the a nail driving groove together with the nail driving member at a distance of the thickness of one nail for each nail shooting action, and finally the touch member pushes the braking member to obliquely swing out of the magazine to a move path of the driving rod. As such, the driving rod is blocked by the braking member, the shooting action of the nail gun is braked, and the operator is reminded to reload nails. However, when braking member is obliquely swung out of the magazine the driving rod is sustained by a slope surface of the braking member that is swung out of the magazine. In such condition, a component force of the force that the driving rod applies to the braking member along an inverse direction of a swing direction of the braking member may force the braking member to swing back to its original position but not stay at the braking position. As described above, the stability of above described braking mechanism is low, and may affect a success rate of the braking action of the braking mechanism. Therefore, there is a desire to overcome aforementioned problems.

BRIEF SUMMARY

The present invention provides a braking and driving mechanism can overcome the problems of insufficient contact area for the driving rod and low stability of braking action in conventional nail guns.

In one embodiment, a braking and driving mechanism includes a guide plate, a driving rod, a magazine, and a pressing rod.

The guide plate includes a longitudinal nail groove extending along a direction same to a nail driving direction of the nail gun. The longitudinal nail groove is communicated with a nail driving groove.

The driving rod is slidably assembled on an end side of the guide plate along the nail driving direction. A stopping portion is formed on an end side of the driving rod.

The magazine is transversely disposed on an end wall of the guide plate. An inner portion of the magazine defines a longitudinal guide groove for supplying nails. The longitudinal guide groove receives a plurality of nails abreast arranged in a row therein and is communicated with the longitudinal nail groove. More than one nail pushing pieces capable of providing an elastic force are arranged in the longitudinal guide groove. The nail pushing piece is configured for pushing the nails to pass through the longitudinal nail groove and enter into the nail driving groove one by one for shooting.

The pressing rod consists of a bar shaped arm extending to form a tongue portion and a pivot portion. The pressing rod is pivotably disposed in the magazine via the pivot portion. An elastic member for driving the arm to transversely press a main body of each of the nails. If the number of remaining nails in the magazine is equal to a default number the elastic member drives the tongue portion to move to a position where the tongue portion can block the stopping portion of the driving rod such that the movement of the driving rod is braked.

According to above described braking and driving mechanism, the arm of the pressing rod extends to further form a pushing portion, the elastic member is disposed between the pushing portion and the magazine, and the pressing rod transversely press the nails abreast arranged in a row in the longitudinal guide groove of the magazine such that the nails cling to the magazine base. Thus, the slide cover can be easily closed. After the slide cover is closed, the pressing rod ensures that the nails pass through the longitudinal nail groove to enter into the nail driving groove one by one for shooting. Simultaneously, the braking and driving mechanism uses the pressing rod to detect the number of the remaining nails, and uses the pivotably disposed pressing rod to produce a large swing arc length for the tongue portion. Thus, the tongue portion can move at a distance in a large swinging arc length range to a position where the tongue portion can block the stopping portion of the driving rod, and this is different with to use a braking member on a nail driving member to brake the driving rod in a conventional nail gun. According to above description, the present braking and driving mechanism can increases a stressed area to stop the movement of the driving rod, improve the stability of braking the driving rod, and further improve the success rate of the braking action of the nail gun.

Additionally, the present invention also provides the following embodiments.

In another embodiment, the tongue portion and the pushing portion extend to be formed respectively on two opposite ends of the pressing rod, and the pivot portion is formed between the tongue portion and the pushing portion.

In still another embodiment, the bevel surface is formed on a portion of the arm between the pivot portion and the pushing portion.

In still another embodiment, the pivot portion of the pressing rod is pivotably disposed on an end side of the magazine base, and the elastic member is disposed between the pushing portion and the magazine base.

In yet another embodiment, the distance between the pivot portion and the tongue portion is greater than the distance between the pivot portion and the pushing portion such that the tongue portion has a large swinging arc length.

However, in order to clearly and fully disclose the present invention, the embodiments will be described in detail accompanying with figures as follows.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
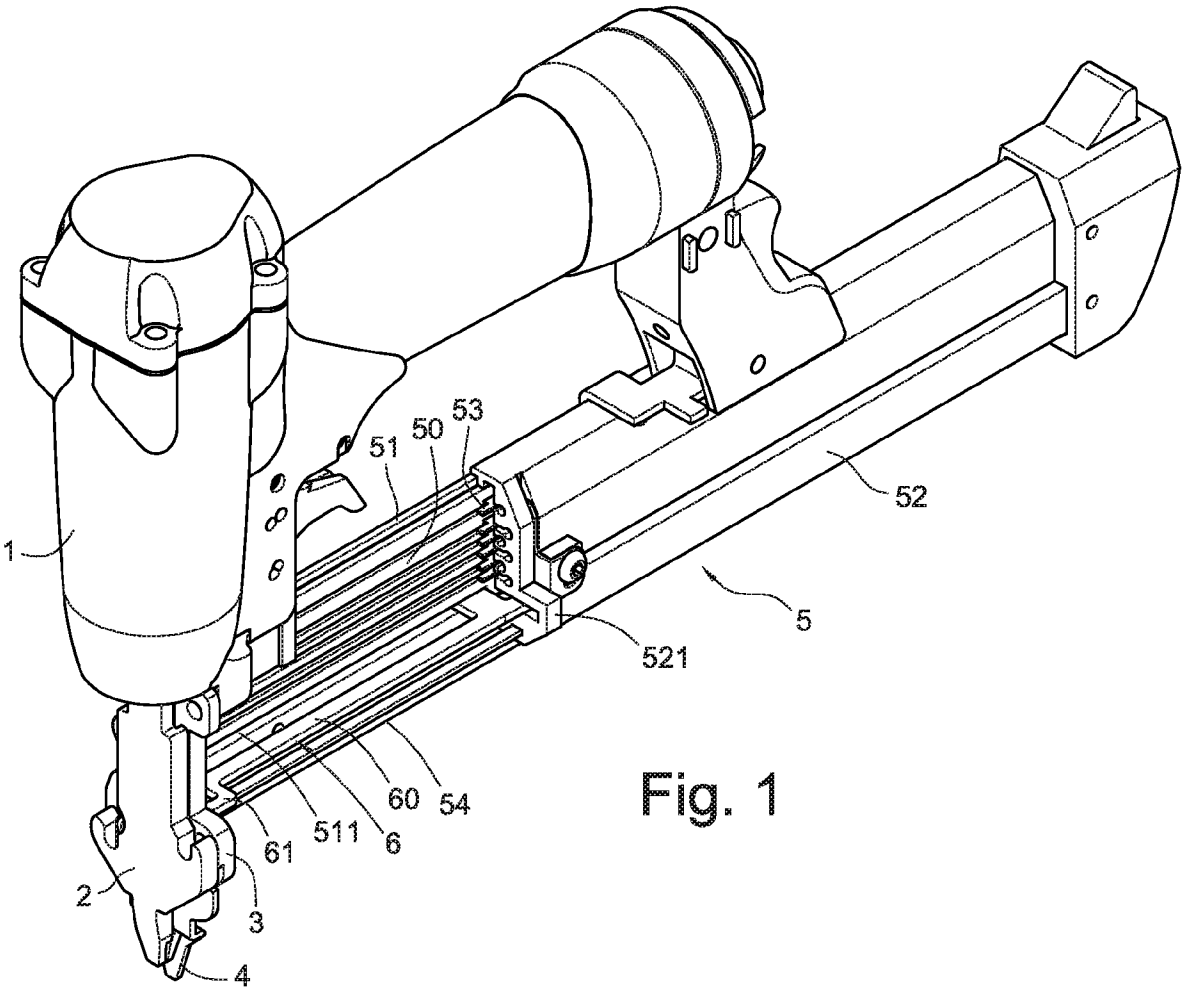
FIG. 1 illustrates a perspective view of an embodiment of the present invention.
Figure 8:
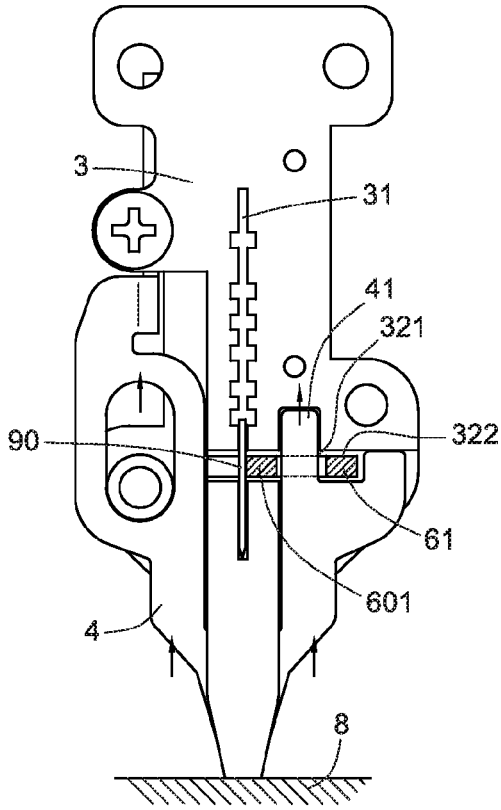
FIG. 8 is a schematic view illustrating an operating state of the components in FIG. 3.

FIG. 1 illustrates a perspective view of an embodiment of the present invention, and a braking and driving mechanism of a nail gun in accordance with the present invention will be described accompanying with FIGS. 2 to 4. The braking and driving mechanism includes a guide plate 3, a driving rod 4, a magazine 5, and a pressing rod 6. The magazine 5 is laterally disposed on an end wall of the guide plate 3, and a guide plate cover 2 is disposed on another end wall of the guide plate 3. An end side of the guide plate cover 2 defines a nail driving groove 21 (as shown in FIG. 5), which is between the guide plate 3 and the guide plate cover 2. The guide plate 3 and the guide plate cover 2 are disposed on a bottom portion of a housing 1. A surface of the guide plate 3 defines a longitudinal nail groove 31 extending along a direction same to the nail driving direction, and a transverse rod groove 32 communicated to the longitudinal nail groove 31. The longitudinal nail groove 31 is also communicated to the nail driving groove 21, and the transverse rod groove 32 includes a first position 321 and a second position 322 communicated to each other. The driving rod 4 is slidably mounted on an end side of the guide plate 3 along the nail driving direction, and is located between the guide plate 3 and the guide plate cover 2. A stopping portion 41 is formed on an end side of the driving rod 4. The stopping portion 41 can freely enter into the first position 321 of the transverse rod groove 32 when the driving rod 4 moves to hit a nail (as shown in FIG. 8).

The magazine 5 consists of a magazine base 51 (referring to FIGS. 1, 2, 4, 5 and 7), and a slide cover 52 slidably assembled on the magazine base 51. An anti-abrasion plate 54 is disposed on an end side of the magazine base 51 and extends to an end side of the slide cover 52. The magazine 5 defines a longitudinal guide groove 50 for supplying nails between the magazine base 51, the slide cover 52 and the anti-abrasion plate 54. The longitudinal guide groove 50 can receives a plurality of nails 9 abreast arranged in a row, and is communicated with the longitudinal nail groove 31. A nail pushing piece 53 that is capable of providing an elastic force is disposed on an end wall of the slide cover 52 opposite to the magazine 51. The nail pushing piece 53 is arranged in the longitudinal guide grove 50, and can push the plurality of nails 9 abreast arranged in the longitudinal guide groove 50 to move through the longitudinal nail groove 31 and enter into the nail driving groove 21 ready for shooting.

Figure 2:
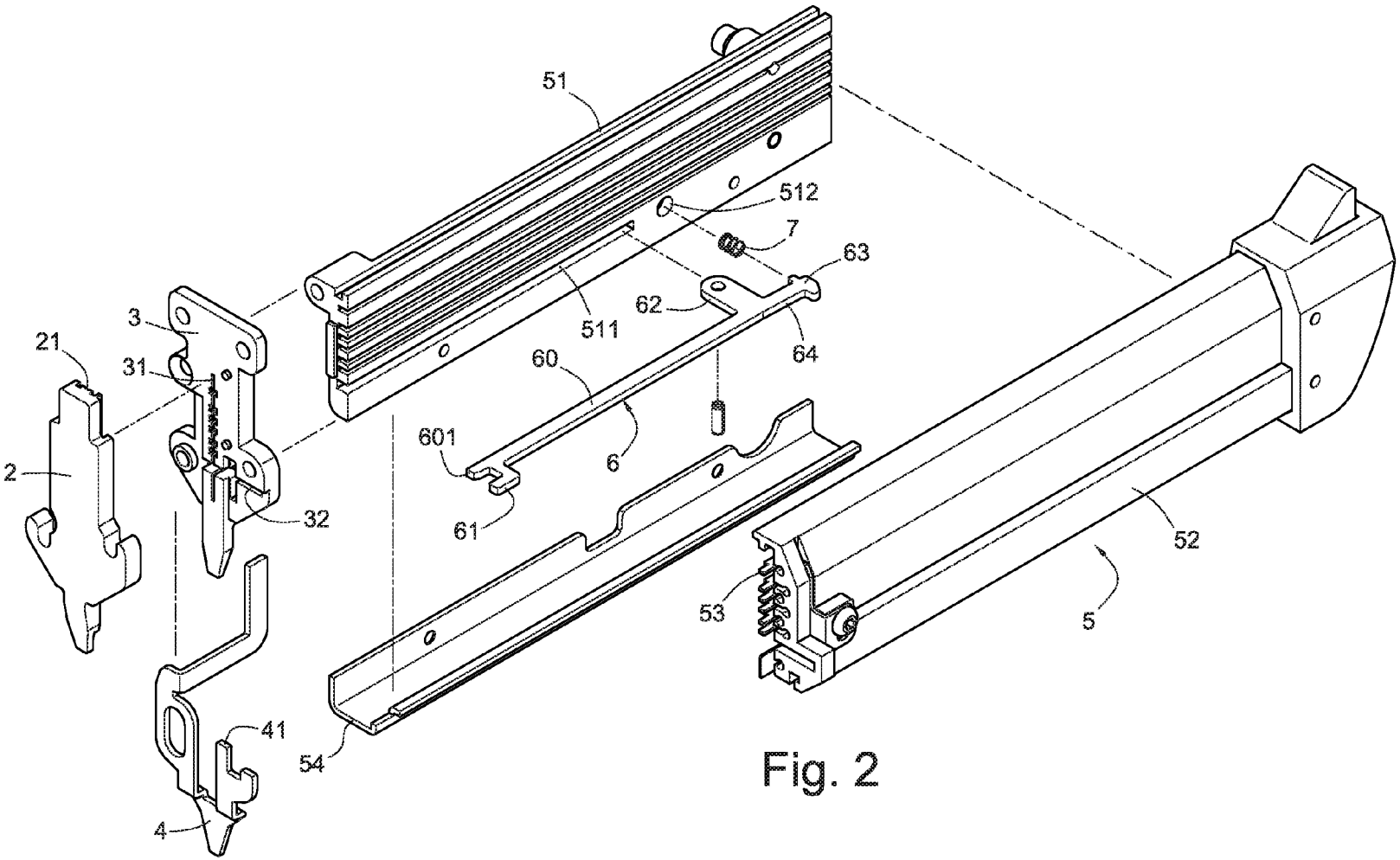
FIG. 2 is an exploded perspective view of a magazine and a guide plate in FIG. 1.
Figure 3:
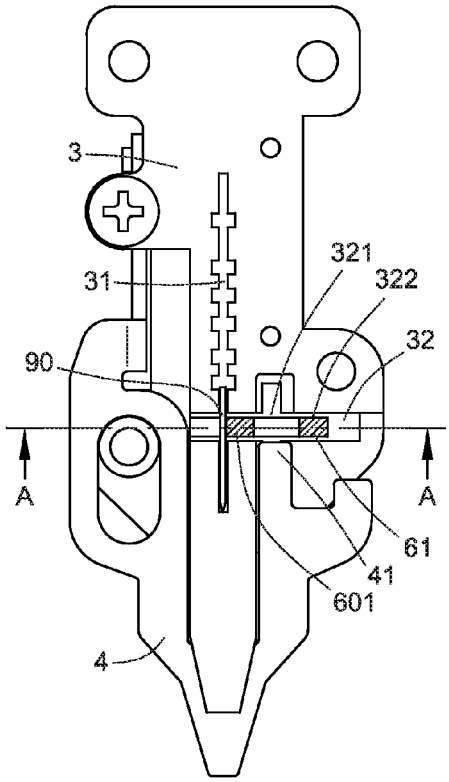
FIG. 3 is a perspective view illustrating a configuration of the guide plate and a tongue portion of the present invention.
Figure 4:
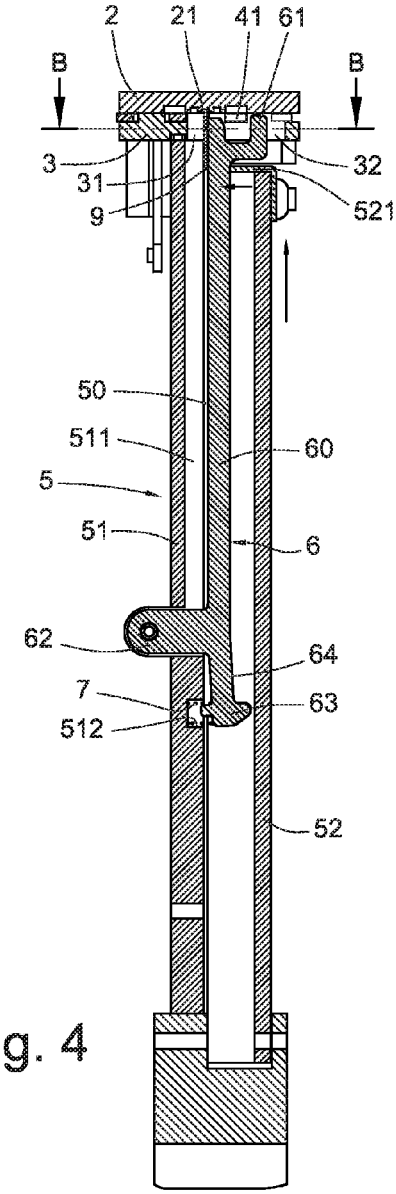
FIG. 4 is a cross sectional view taken along the line A-A in FIG. 3.
Figure 5:
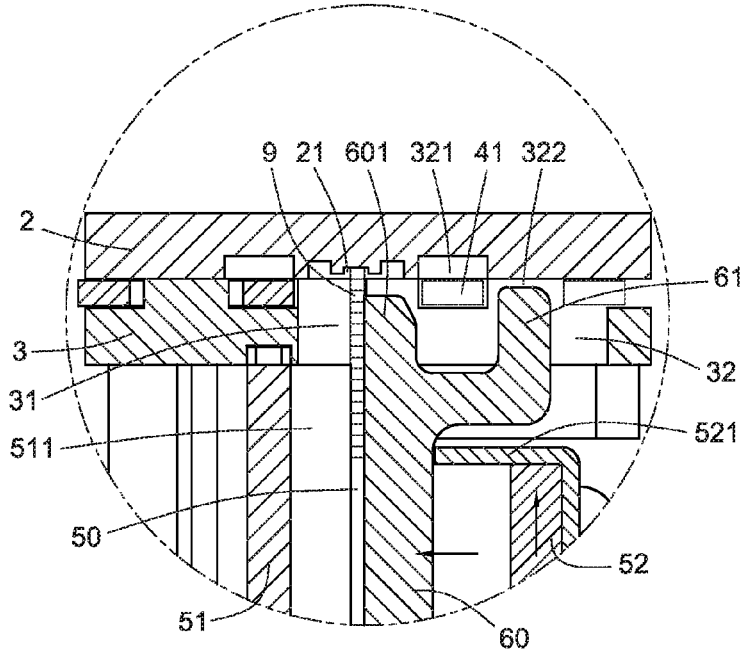
FIG. 5 is a partial enlarged view of the tongue portion in FIG. 4.
Figure 11:
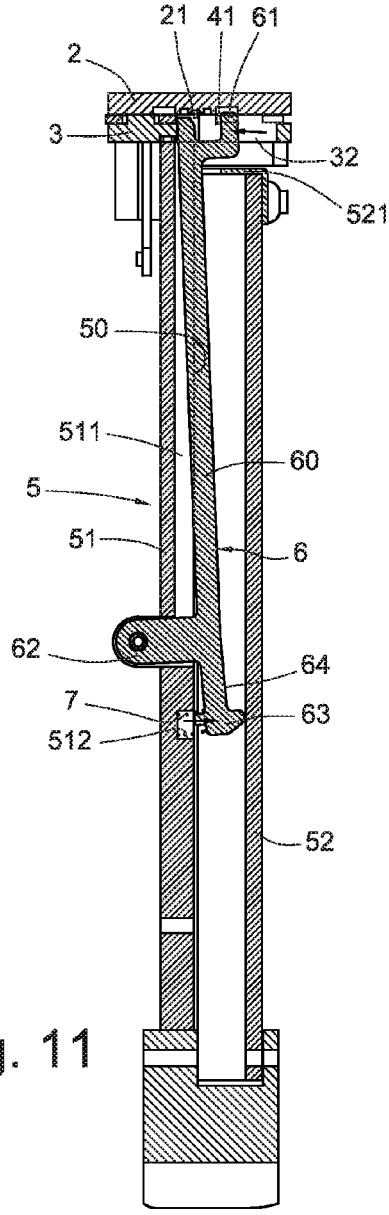
FIG. 11 is a schematic view illustrating an operating state of the components in FIG. 4.
Figure 12:
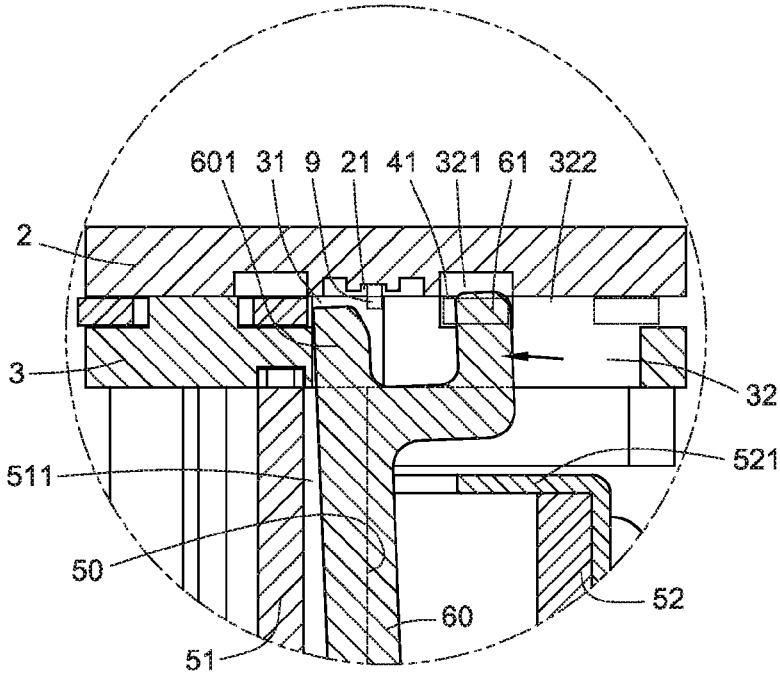
FIG. 12 is another schematic view illustrating an operating state of the components in FIG. 5.

The pressing rod 6 has a bar shaped arm 60 (see FIGS. 1, 2, and 4). A tongue portion 61 and a pushing portion 63 extend from two opposite ends of the arm 60, respectively (as shown in FIGS. 3, 5, 6, and 7). A pivot portion 62 is formed between the tongue portion 61 and the pushing portion 63, and a distance between the pivot portion 62 and the tongue portion 61 is greater than that between the pivot portion 62 and the pushing portion 63. A longitudinal trench portion 511 communicated with the longitudinal guide groove 50 is formed in an end wall of the magazine base 51 opposite to the slide cove 52, and an end wall of the magazine base 51 that is adjacent to an end of the longitudinal trench portion 511 away from the longitudinal nail groove 31 defines a buried hole 512 therein. The pressing rod 6 is pivotably disposed in an end of the longitudinal trench portion 511 away from the longitudinal nail groove 31 via the pivot portion 62 such that the pivot portion 62 is adjacent to the buried hole 512. As such, the pressing rod 6 can freely swing within the longitudinal groove 50 and the longitudinal trench portion 511 (as shown in FIGS. 11 and 12). An elastic member 7 is disposed on the pushing portion 63. In the present embodiment, the elastic member 7 is a spring disposed in the buried hole 512 and pressed between the pushing portion 63 and the magazine base 51. The elastic member 7 can drive the arm 60 of the pressing rod 6 to swing to the magazine base 51 via the pressing portion 63 such that the arm 60 transversely presses main body 90 of each of the nails 9 and the tongue portion 61 is received in the second position 322 of the transverse rod groove 32.

Figure 9:
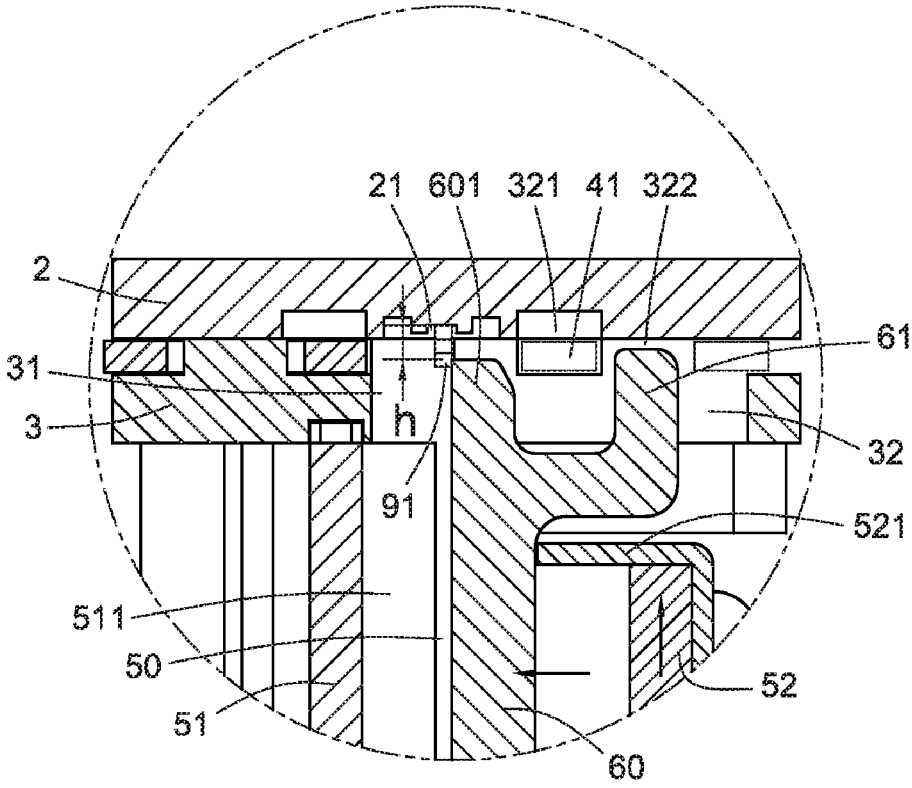
FIG. 9 is a schematic view illustrating an operating state of the components in FIG. 5.
Figure 10:
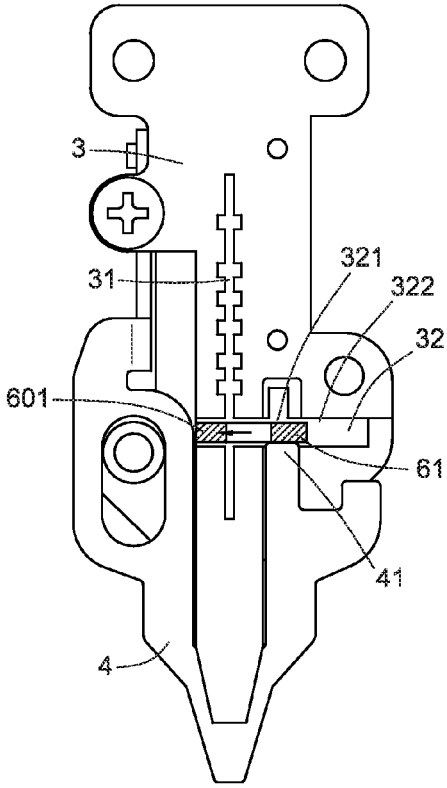
FIG. 10 is another schematic view illustrating an operating state of the components in FIG. 3.
Figure 13:
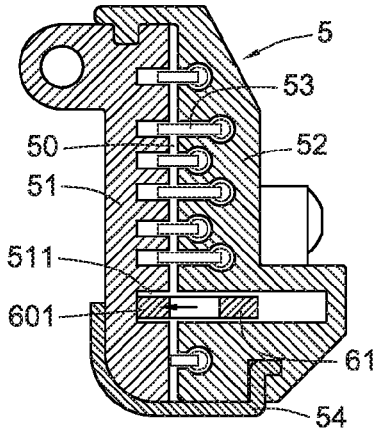
FIG. 13 is a schematic view illustrating an operating state of the components in FIG. 7.

A distance between an end portion 601 (as shown in FIG. 9) of the arm 60 adjacent to the nail driving groove 21 and an inner wall of the nail driving groove 21 "h" is the total thickness of the remaining nails 9 in the magazine 5 when the braking and driving mechanism brakes the shooting action. Thus, the number of the remaining nails 9 in the magazine 5 and the nail driving groove 21 (default number) can be predetermined by adjusting the distance "h". In the present embodiment, the default number of the remaining nails 9 can be two. In other words, if there are 3 nails 9 in the magazine 5 and the nail driving groove 21 (see FIG. 9) the end portion 601 of the arm 60 is still sustained by a last nail 91. However, if there are only two nails 9 in the magazine 5 and the nail driving groove 21 (see FIG. 12), the end portion 601 of the arm 60 loses the support from the nails 9 and the arm 60 is driven by the elastic member 7 to swing towards the magazine base 51 (as shown in FIGS. 10, 11, and 13) such that the tongue portion 61 moves in the transverse rod groove 32 to the first position 321. As a result, the tongue portion 61 blocks the stopping portion 41 of the driving rod 4 and the moving of the driving rod 4 is braked.

Figure 6:
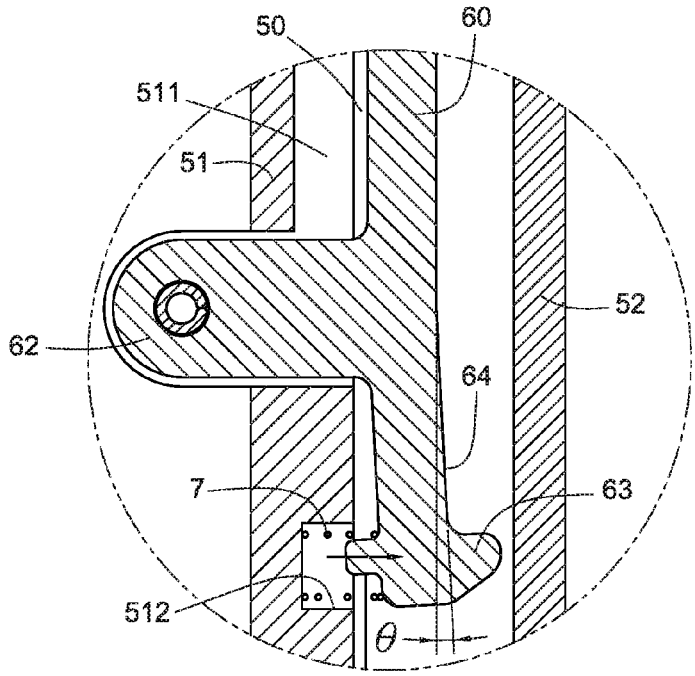
FIG. 6 is partial enlarge view of a pushing portion in FIG. 4.
Figure 7:
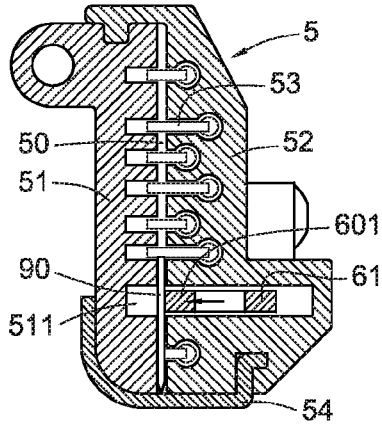
FIG. 7 is a cross sectional view taken along the line B-B in FIG. 4.
Figure 16:
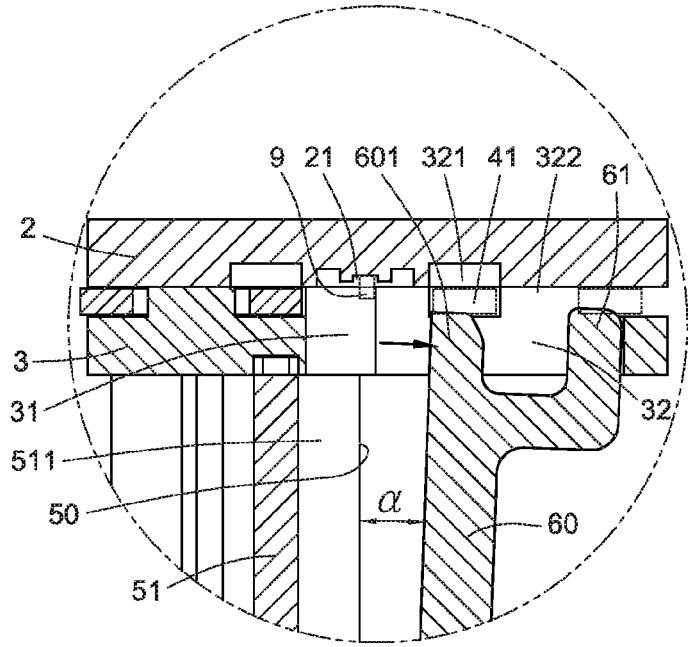
FIG. 16 is still another schematic view illustrating an operating state of the components in FIG. 5.
Figure 17:
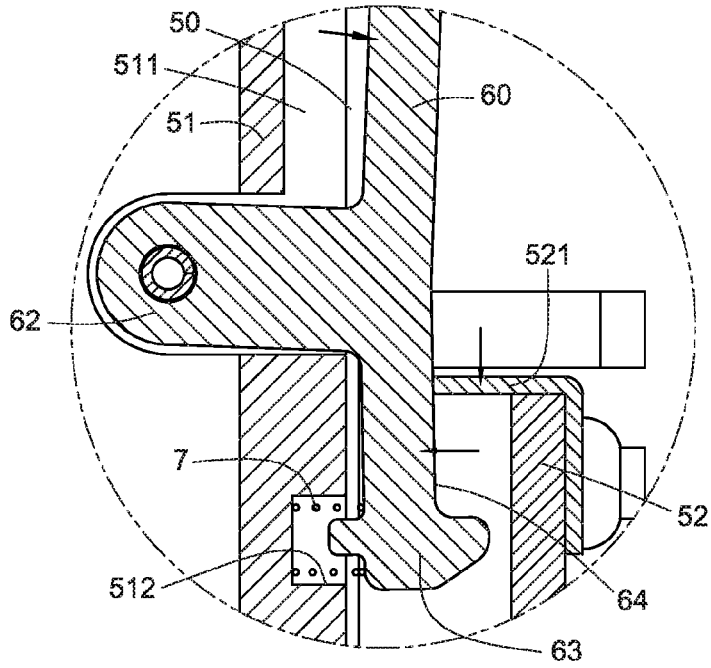
FIG. 17 is a schematic view illustrating an operating state of the components in FIG. 6.
Figure 18:
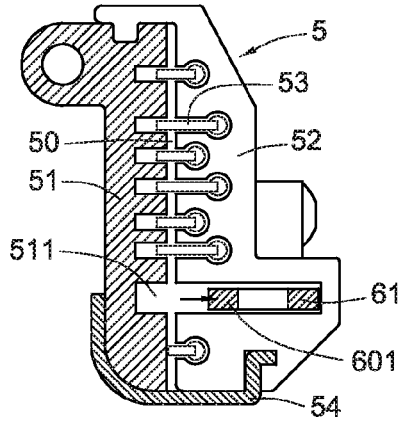
FIG. 18 is still another schematic view illustrating an operating state of the components in FIG. 7.

A pushing plate 521 (referring to FIGS. 4 and 5) is disposed on an end portion of the slide cover 52 for contacting the guide plate 3. A bevel surface 64 facing towards the slide cover 52 is defined on a portion of the arm 60 that is at a side of the pushing portion 63. The bevel surface 64 is in a surface of the arm 60 that is between the pivot portion 62 and the pushing portion 63 of the pressing rod 6. The bevel surface 64 extends from a surface of the arm 60 between the pivot portion 62 and the pushing portion 63 in a direction at an angle θ (as shown in FIG. 6) with the surface and towards the pushing portion 63. The pushing plate 521 presses the bevel surface 64 (referring to FIGS. 14 and 17) when slides with the slide cover 52 to open the longitudinal guide groove 50 such that the pressing rod 6 is swung at a predetermined angle α with a surface of the magazine 5 (see FIG. 16) and the end portion 601 of the arm 60 moves in the longitudinal rod groove 32 to the first position 321 (as shown in FIGS. 15 and 18). As such, the pressure applied onto the nails 9 abreast arranged in a row by the arm 60 is released.

According to the parts described above, it is adequate to practice the braking technology of nail shooting of the present invention. The practical operating status of the braking and driving mechanism will be described in detail as follows.

When there are a plurality of nails 9 abreast arranged in a row in the magazine 5 and the nail driving groove 21 (as shown in FIGS. 4 and 5) the arm 60 of the pressing rod 6 can be driven by the elastic member 7 to swing to the magazine base 51 (as shown in FIG. 6). The arm 60 transversely presses the main body 90 of each of the nails 9 (see FIGS. 3 and 7), and simultaneously, the tongue portion 61 is received in the second position 322 of the transverse rod groove 32. In such condition, the driving rod 4 can be driven to move. At this moment, the operator can press a bottom of the driving rod 4 on a surface of a workpiece 8 (as shown in FIG. 8), the stopping portion 41 of the driving rod 4 freely enters into the first position 321 of the transverse rod groove 32 to trigger a trigger valve of the nail gun to shoot a nail 9.

When the number of the remaining nails 9 in the magazine 5 and the nail driving groove 21 is equal to above default number, the elastic member 7 drives the arm 60 of the pressing rod 6 swing to the magazine base 51 (referring to FIGS. 11 and 13). An end of the arm 60 enters into the longitudinal trench portion 511, and simultaneously, the tongue portion 61 is driven to move in the transverse rod groove 32 to the first position 321 (as shown in FIG. 10) which is on the move path of the stopping portion 41 of the driving rod 4. During this period, because the distance between the pivot portion 62 and the tongue portion 61 is greater than the distance between the pivot portion 62 and the pushing portion 63, thus a swinging arc length of the tongue portion 61 is greater than that of the pushing portion 63. Therefore, the tongue portion 61 can move at a distance in a large swinging arc length range to a position where the tongue portion can block the stopping portion 41 of the driving rod 4. Accordingly the tongue portion 61 can use an area having a width wider than the thickness of one nail 9 to stop the driving rod 4 to move. At this time, if the operator presses the bottom of the driving rod 4 on the surface of the workpiece, the stopping portion 41 of the driving rod 4 is blocked by the tongue portion 61 at the first position 321 and can not further move. As a result, the shooting action of the nail gun is braked.

Figure 14:
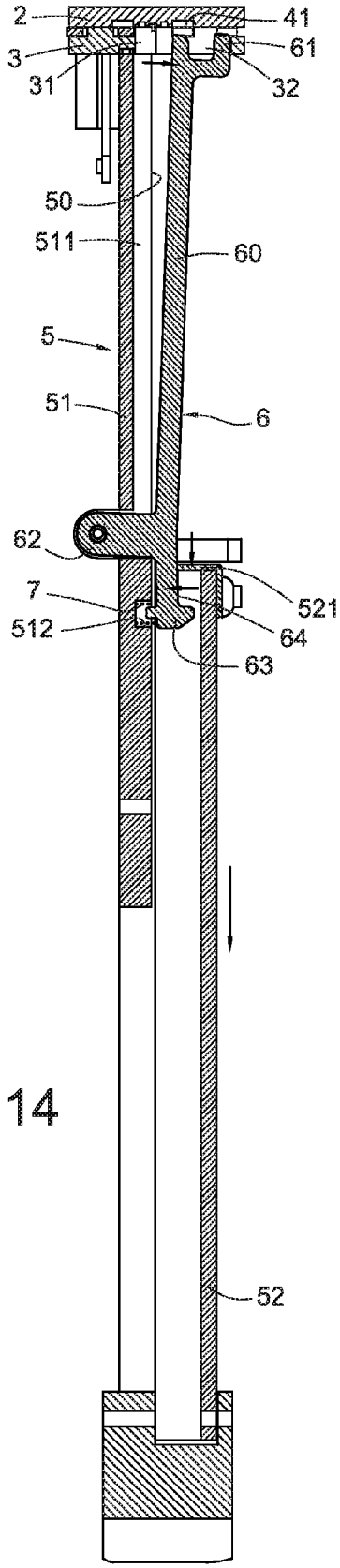
FIG. 14 is another schematic view illustrating an operating state of the components in FIG. 4.
Figure 15:
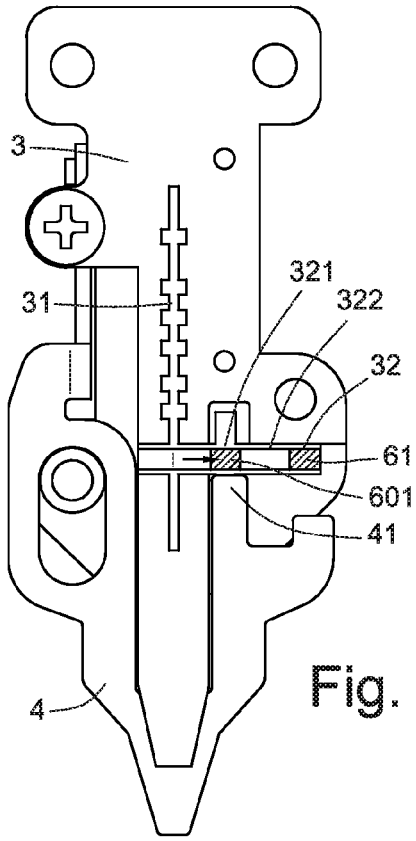
FIG. 15 is still another schematic view illustrating an operating state of the components in FIG. 3.

When the operator wants to reload nails or nails are jammed in the magazine 5 or the nail driving groove 21, the slide cover 52 can be pushed to a direction opposite to the guide plate 3 (as shown in FIG. 14) to open the longitudinal guide groove 50. At this time, the pushing plate 521 slide with the slide cover 52 to press the bevel surface 64 of the pressing rod 6 (referring to FIG. 17) such that the pressing rod is swung at the predetermined angle α (see FIG. 16) and the end portion 601 of the arm 60 is moved in the transverse rod grove 32 to the second position 322 (as shown in FIGS. 15 and 18). As such, the nails in the magazine 5 and the nail driving groove 21 can be removed, and also, the nails 9 abreast arranged in a row can be reloaded into the longitudinal guide groove 50 of the magazine 5.

It is believed that above description fully and clearly discloses the necessary technical contents for practicing the present braking and driving mechanism. Especially, the pressing rod 6 transversely press the nails 9 abreast arranged in a row in the longitudinal guide groove 50 of the magazine 5 such that the nails 9 cling to the magazine base 51. Thus, the slide cover 52 can be easily closed. After the slide cover 52 is closed, the pressing rod 6 ensures that the nails 9 passes through the longitudinal nail groove 31 to enter into the nail driving groove 21 one by one for shooting. Simultaneously, the braking and driving mechanism uses the pressing rod 6 to detect the number of the remaining nails 9, and uses the pivotably disposed pressing rod 6 to produce a large swing arc length for the tongue portion 61. Thus, the tongue portion 61 can move at a distance in a large swinging arc length range to a position where the tongue portion can block the stopping portion 41 of the driving rod 4, and this is different with to use a braking member on a nail driving member to brake the driving rod in a conventional nail gun. According to above description, the present braking and driving mechanism can increases a stressed area to stop the movement of the driving rod 4, improve the stability of braking the driving rod 4, and further improve the success rate of the braking action of the nail gun.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A braking and driving mechanism, comprising:

a guide plate, comprising a longitudinal nail groove extending along a direction same to a nail driving direction of the nail gun, the longitudinal nail groove being communicated with a nail driving groove;

a driving rod slidably assembled on an end side of the guide plate along the nail driving direction, a stopping portion being formed on an end side of the driving rod;

a magazine transversely disposed on an end wall of the guide plate, an inner portion of the magazine defining a longitudinal guide groove for supplying nails, the longitudinal guide groove receiving a plurality of nails abreast arranged in a row therein and being communicated with the longitudinal nail groove, more than one nail pushing pieces capable of providing an elastic force being arranged in the longitudinal guide groove, the nail pushing piece being configured for pushing the nails to pass through the longitudinal nail groove and enter into the nail driving groove one by one for shooting; and a pressing rod consisting of a bar shaped arm extending to form a tongue portion and a pivot portion, the pressing rod being pivotably disposed in the magazine via the pivot portion, an elastic member for driving the arm to transversely press a main body of each of the nails, if the number of remaining nails in the magazine is equal to a default number the elastic member driving the tongue portion to move to a position where the tongue portion can block the stopping portion of the driving rod such that the movement of the driving rod is braked.

2. The braking and driving mechanism of claim 1, wherein the guide plate defines a longitudinal rod groove communicated to the longitudinal nail groove, the longitudinal rod groove having a first position and a second position communicated with each other, the second position being configured for receiving the tongue portion, and the first position being configured for receiving the stopping portion, the first position being the default position where the tongue portion blocks the stopping portion.

3. The braking and driving mechanism of claim 1, wherein the arm of the pressing rod extending to further form a pushing portion, and the elastic member is disposed between the pushing portion and the magazine.

4. The braking and driving mechanism of claim 3, wherein the magazine consists of a magazine base transversely disposed on an end wall of the guide plate and a slide cover slidably assembled on the magazine base, the longitudinal guide groove being formed between the magazine base and the slide cover, a pushing plate being disposed on an end portion of the slide cover, a bevel surface being formed on a portion of the arm at the side of pushing portion, the pushing plate pressing the bevel surface when slides together with the slide cover to open the longitudinal guide groove such that the pressing rod is swung at a predetermined angle $\alpha$ so as to release the pressure applied onto the nails abreast arranged in a row by the arm.

5. The braking and driving mechanism of claim 4, wherein the pivot portion of the pressing rod is pivotably disposed on an end side of the magazine base.

6. The braking and driving mechanism of claim 3, wherein the tongue portion and the pushing portion extend to be formed respectively on two opposite ends of the pressing rod.

7. The braking and driving mechanism of claim 3, wherein the pivot portion is formed between the tongue portion and the pushing portion.

8. The braking and driving mechanism of claim 3, wherein a distance between the pivot portion and the tongue portion is greater than that of the pivot portion and the pushing portion.

* * * * *